US006744699B2

(12) United States Patent
Klein et al.

(10) Patent No.: US 6,744,699 B2
(45) Date of Patent: Jun. 1, 2004

(54) ELECTRONIC REGULATION MODULE FOR THE MOVEMENT OF A MECHANICALLY WOUND WATCH

(75) Inventors: Eric Klein, Neuchatel (CH); Konrad Schafroth, Berne (CH)

(73) Assignee: Richemont International SA, Villars-sur-Glane (CH)

( * ) Notice: Subject to any disclaimer, the term of this patent is extended or adjusted under 35 U.S.C. 154(b) by 0 days.

(21) Appl. No.: 10/176,621

(22) Filed: Jun. 24, 2002

(65) Prior Publication Data

US 2003/0002392 A1 Jan. 2, 2003

(30) Foreign Application Priority Data

Jul. 2, 2001 (CH) ..... 1214/01

(51) Int. Cl.[7] ..... G04C 1/00; G04C 3/00
(52) U.S. Cl. ..... 368/204; 368/203; 368/206
(58) Field of Search ..... 368/203–204, 368/206–207

(56) References Cited

U.S. PATENT DOCUMENTS 4,321,520 A * 3/1982 Ueda et al. ..... 318/696
4,799,003 A * 1/1989 Tu et al. ..... 322/29
5,448,167 A * 9/1995 Takagi ..... 324/177
5,881,027 A * 3/1999 Schafroth ..... 368/203
6,041,021 A * 3/2000 Shinkawa et al. ..... 368/64
RE36,733 E * 6/2000 Wiget ..... 368/249
6,194,878 B1 * 2/2001 Schafroth ..... 322/29
6,208,119 B1 * 3/2001 Schafroth ..... 322/29
6,314,059 B1 * 11/2001 Shimizu et al. ..... 368/157
6,477,116 B1 * 11/2002 Shinkawa et al. ..... 368/157

FOREIGN PATENT DOCUMENTS

| | | |
|---|---|---|
| CH | 597 636 | 5/1977 |
| EP | 0 239 820 B1 | 10/1989 |
| EP | 0 679 968 A1 | 11/1995 |
| EP | 0 816 955 A1 | 1/1998 |
| EP | 0 848 842 B1 | 4/1999 |
| EP | 1 041 464 A2 | 10/2000 |

* cited by examiner

*Primary Examiner*—David Martin
*Assistant Examiner*—Michael L. Lindinger
(74) *Attorney, Agent, or Firm*—Young & Thompson

(57) ABSTRACT

An electronic module for regulation of a watch movement with mechanical winding includes a generator (1) permitting converting the mechanical energy supplied by the mechanical watch movement into a measuring signal (G+;G−) and an electronic circuit (11) supplied by the generator. The electronic circuit includes an energy dissipation circuit (9) permitting applying at least two separate braking couples more than zero to the generator (1). The electronic circuit (11) also includes a counter to control the braking circuit. The braking couple selected by the control circuit depends on the advance of the generator and is reduced, without being suppressed, when the measuring signal (G+;G−) passes through an extreme.

20 Claims, 6 Drawing Sheets

ELECTRONIC REGULATION MODULE FOR THE MOVEMENT OF A MECHANICALLY WOUND WATCH

BACKGROUND OF THE INVENTION

The present invention relates to an electronic regulation module for the movement of a mechanically wound watch, and a process for regulating the speed of a mechanically wound watch movement by means of an electronic module.

DESCRIPTION OF THE RELATED ART

All watches need a source of energy to drive the movement and move the hands.

In the case of mechanical watches, this energy is supplied by the user by winding the stem or, in the case of automatic watches, by movements of an oscillating mass arising from movement of the wrist and permitting loading a spring.

Mechanical watch movements most often use an anchor escapement as a regulation member to guarantee precise operation of the watch. This purely mechanical element however does not permit ensuring satisfactory precision of operation.

Electronic watches, particularly quartz watches, have greater precision. The energy is most often supplied by a battery. These batteries have particularly the following drawbacks:

- Requiring returning periodically to a watchmaker to replace the battery.
- The risk of losing watertightness of the watch during that replacement.
- Requiring distributing to a network of dealers a very large assortment of different batteries for as long a period as possible.
- Ecological problems associated with disposal of the batteries.
- Substantial cost of replacement and changing.

Different attempts have thus been carried out to omit batteries from quartz watches. The use of photovoltaic cells is attractive, but imposes substantial aesthetic drawbacks. Sources of energy based on temperature gradient or on the acidity of the skin of the wearer are also in an experimental stage. Other sources of energy envisageable for other portable apparatus cannot be sufficiently miniaturized to be integrated into the reduced volume of a wristwatch.

To prolong the lifetime of batteries, quartz watches are known in which the battery is recharged by a mechanical energy source. In this case, the mechanical energy produced by movements of the user is accumulated in a spring, as in automatic watches, then transmitted through a gear train to a generator which converts it into electrical energy used to recharge the battery. This battery supplies a conventional quartz movement with a stepwise clock motor. This system thus permits prolonging the lifetime of the battery, but not completely eliminating it. It is nevertheless quite necessary to replace it periodically. Moreover, these watches require a generator in addition to the motor, which gives rise to increased cost and occupies a substantial volume in the watch. Finally, the movement of the hands is characteristically jerky, which is not attractive, in watches with a stepwise motor.

The patent CH597636 provides a construction permitting completely eliminating the battery from a quartz watch. In this movement, the energy produced by movements of the user is accumulated in a spring, then transmitted through a gear train to the hands of the watch as well as to a generator which converts it into electricity (source of AC voltage). This voltage source is rectified so as continuously to supply an electronic circuit including a quartz oscillator. The electronic circuit adjusts the operation of the watch by acting on the electrical torque applied to the generator. When the generator turns too rapidly, the electronic circuit brakes it by short-circuiting it (all-or-nothing braking). The ideal reference speed is supplied by the quartz oscillator.

The document EP0 239 820 discloses a process for adjusting the speed of a generator in which the speed of the generator is also adjusted all-or-nothing, with the help of a brake control signal. The brake control signal is synchronized with a reference signal obtained from a quartz oscillator. At each cycle of the reference signal, the brake control signal passes first of all from the zero logic condition to the logic condition one, and then returns from the logic condition one to the zero logic condition.

The brake control signal thus depends solely on the reference signal and is not synchronized with the measuring signal produced by the generator. When the phase or frequency of the reference signal and of the measuring signal from the generator are quite different, which can take place for example at the startup of the system or following a violent shock, the control impulses of the brake can arise at the most unfavorable time for the generator, for example when the voltage at the output terminals just passes through a maximum. As will be seen later, this situation can give rise to abrupt stopping of the watch.

EP0 679 968 discloses another control module permitting applying "all-or-nothing" braking to the generator. When the generator rotor advances, the control module sends very short control pulses which have the effect of short-circuiting the generator. Braking by short-circuiting being very abrupt, the duration of the braking pulses is necessarily very short.

The all-or-nothing braking process described in the above documents has the drawback of imposing very brief and very intense decelerations on the rotor of the generator. After each braking pulse, the rotor and the gear train need considerable energy to accelerate and then to return to a speed near the reference speed fixed by the quartz oscillator. This mode of operation by shock is thus less energetically efficient, such that sufficient autonomy of the watch can be obtained only by using energy storage means, in the mechanical form of a spring or in the electrical form of capacitors, which are very voluminous. The watch movements obtained with this technology thus cannot be miniaturized without decreasing the autonomy of the watch below an acceptable minimum.

The application EP0 816 955, to which the reader can profitably refer, as well as the patent EP0 848 842 disclose another control module permitting applying to the rotor of the generator a braking couple which depends on the advance of the rotor. The braking circuit comprises several impedances of different values, which can be independently selected to apply different separate braking couples that are not zero, to the generator. The resulting impedance of the braking circuit depends on the advance of said generator. This device thus permits applying a braking couple proportional to the advance of the generator. The generator is so dimensioned as to turn slightly more rapidly than the reference speed, so as to permit adjustment of the speed. In a stable state, the braking circuit thus brakes continuously with a braking couple much weaker than in the all-or-nothing braking systems. Braking is interrupted solely when the generator turns too slowly, for example at startup or following a shock. This module thus permits avoiding abrupt decelerations of the rotor and thus is more energy efficient.

The control module described in this document has however the drawback of braking even when the AC voltage at the terminals of the generator passes through a maximum. When the generator is advancing, which is to say in the most usual situation, the peak-to-peak voltage at the output terminals of the generator is thus reduced by this braking. The storage capacities hence can use only a decreased recharge voltage. So as to maintain sufficient supply voltage for the electronic circuit, it is thus necessary slightly to overdimension the generator or in any case to provide storage capacities of a sufficient value, for the energy.

This problem is even more crucial in the circuit disclosed by EP0 239 820 mentioned above, because in this case the braking pulses, which are synchronized with the quartz reference signal, can according to the relative dephasing of the measuring signal and of the reference signal sometimes be produced just at the time at which the voltage of the terminals of the generator is at a maximum. The short-circuiting of the generator produces an instantaneous abrupt voltage drop, such that the storage capacitances are not at all recharged. If the voltage in the storage capacitances falls below the minimum requirement, the circuit is in danger of completely stopping.

EP1 041 464 discloses a control module in which the brake is actuated by means of braking impulse trains. At each impulse, the rotor is abruptly braked, for a very short time, but nevertheless requiring an acceleration between two pulses. The rotor thus undergoes a multitude of successive accelerations and decelerations during each cycle. Moreover, the circuit does not permit preventing a braking pulse from taking place at the moment at which the voltage at the outlet of the generator passes through an extreme. Finally, the generator of these pulse trains require complex combination logic and consumes substantial current.

SUMMARY OF THE INVENTION

An object of the invention is to provide a new construction of a module for regulating a quartz watch without a battery, permitting overcoming the drawbacks of known constructions, particularly the problems of autonomy, volume and electrical storage in an electrochemical battery.

Another object of the invention is to provide a new construction of a regulation module for a quartz watch without a battery, permitting recovering with minimum loss the peak-to-peak voltage produced by the generator to supply the circuit whilst avoiding the problems of abrupt deceleration of the rotor arising in all-or-nothing braking modules by short-circuiting the generator.

Another object is to improve the braking process at several levels suggested by EP0 816 955 and to solve particularly the problem of peak-to-peak voltage drop arising from continuous braking.

Another object of the invention is to provide a new construction of a quartz regulation module without a battery, that can be produced and sold freely and independently of technologies proposed by other manufacturers.

These objects are achieved by means of a module having the elements disclosed below and by a process having the steps disclosed below.

In particular, these objects are achieved with the help of an electronic module for regulation of a watch movement with mechanical winding, comprising a generator permitting converting mechanical energy supplied by the mechanical watch movement into a measuring signal, an electronic circuit supplied by said generator and comprising a braking circuit permitting applying at least two separate braking couples that are not zero, to said generator, said electronic circuit moreover comprising a control circuit for the braking circuit, so as to control the speed of rotation of said generator, the braking couple selected by said control circuit depending particularly on the advance of the generator, and in which the braking couple is reduced when said measuring signal passes through an extreme.

Relative to the modules of the prior art, this regulation module has the particular advantage of reducing the braking when the measuring signal passes through an extreme. It is thus possible to use the peak-to-peak voltage of the measuring signal to charge the storage capacitors with sufficient energy to supply the circuit. As the braking circuit permits applying at least two separate braking couples that are zero, it is possible to reduce the braking without completely interrupting it, and thereby to avoid the abrupt decelerations typical of the all-or-nothing braking systems.

In a preferred modification, the braking is reduced during a fixed time, or at least a limited time, when the measuring signal passes through an extreme. The duration of reduction of braking is selected so as to be sufficient to guarantee a complete recharging of the storage capacitors, whilst leaving a sufficiently long braking time to permit precise regulation even with low braking couples.

In a preferred modification, the braking couple is progressively reduced before the, measuring signal passes through an extreme, then progressively re-established after said measuring signal has passed through said extreme. There is thus avoided all the shocks arising from abrupt variations of the applied braking couple.

Relative to modules known to the prior art, the module of the invention thus permits applying at each instant a braking couple which depends both on the advance of the rotor and on the instantaneous phase of the measuring signal at the terminals of the generator, so as to obtain the following advantages:

- Avoiding abrupt braking pulses, most particularly when the measuring signal at the terminals of the generator passes through an extreme.
- Avoiding abrupt variations in the braking couple, so as to maintain a speed of rotation of the rotor as constant as possible and as close as possible to the reference speed given by the quartz oscillator.
- Recharging the storage capacitors at the time at which the output voltage of the generator passes through an extreme by reducing the braking, but without interrupting it abruptly.

BRIEF DESCRIPTION OF THE DRAWINGS

The invention will be better understood from a reading of the description of an embodiment of the invention, illustrated by the accompanying drawings, in which.

DESCRIPTION OF THE PREFERRED EMBODIMENTS

Figure 1:
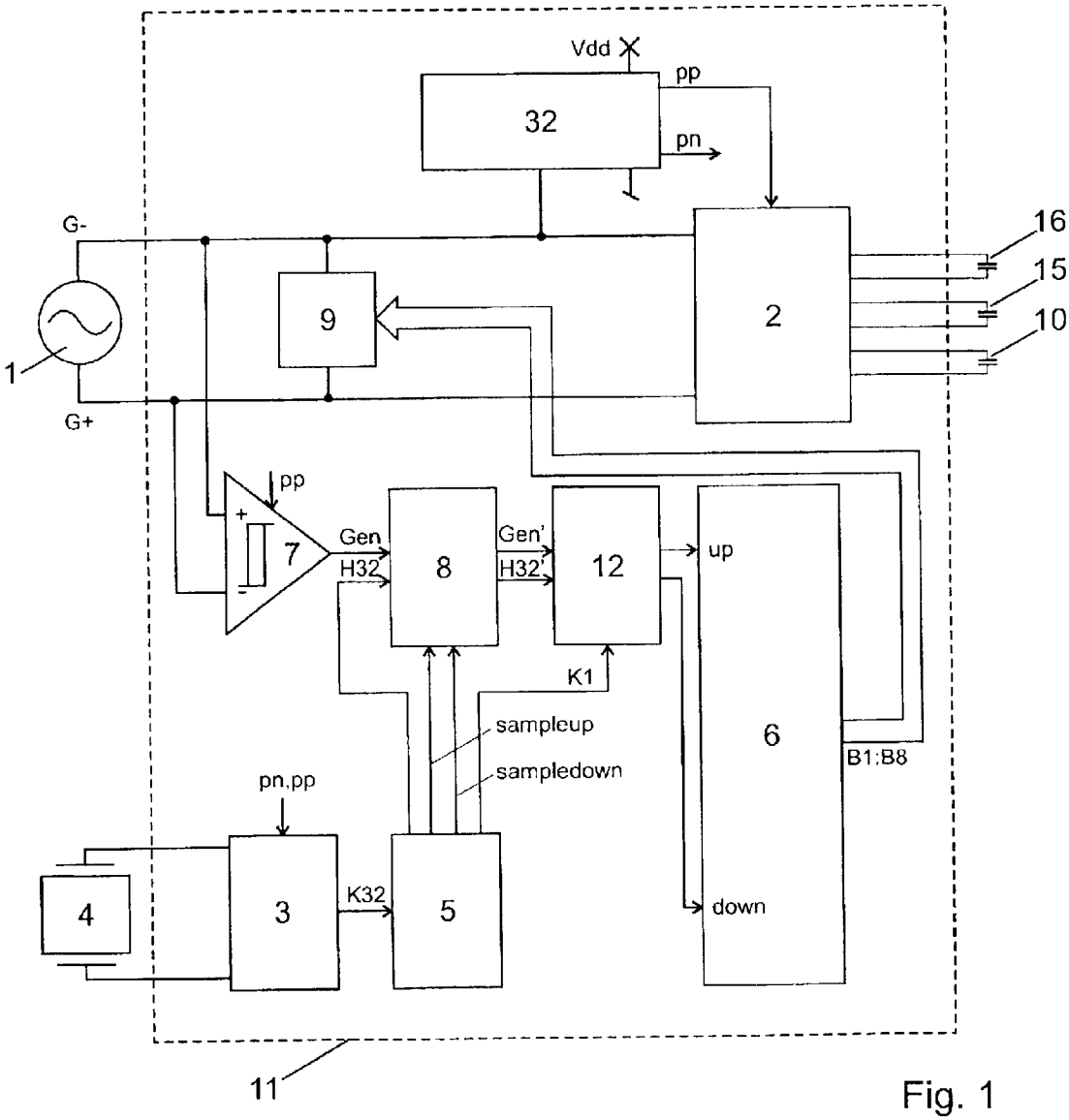
FIG. 1 is a block diagram of an example of an electronic regulation module according to the invention.

FIG. 1 is a block diagram of an electronic regulation circuit 11 according to the invention. The circuit 11 is preferably in the form of a discrete integrated circuit and is adapted to be mounted on a module, for example on a printed circuit card, in an autonomous electrical device, for example a watch, a portable telephone, a calculator or a pocket computer, an auditory or medical prosthesis, etc. In addition to the electronic circuit 11, the module moreover comprises an electromechanical generator 1 adapted to supply electrically the electronic circuit 11 and whose speed of rotation is to be regulated. In the case of a mechanical watch, the generator 1 is for example driven by the gear train (not shown) of the watch where it occupies the place and function conventionally belonging to an anchor escapement. A spring (not shown) loaded by a balance (not shown) drives in rotation the motor of the generator 1 by means of the gear train. The generator 1 converts the mechanical energy received into electrical energy, permitting supplying the circuit 11. By varying the impedance of an energy dissipation circuit 9 connected to the terminals of the generator, the circuit 11 controls the speed of rotation of the rotor of the generator such that the latter corresponds to a reference speed given by a quartz oscillator 4.

The generator is for example of the type described in the patent EP0 851 322. The reference frequency of the AC voltage supplied by the generator is preferably of the form $2^n$ Hz, n being a whole number. In a preferred embodiment, the output signal of the generator has a frequency of 16 Hz. The mechanical portion of the watch corresponds to the state of the art described for example in the document CH597636.

Figure 4:
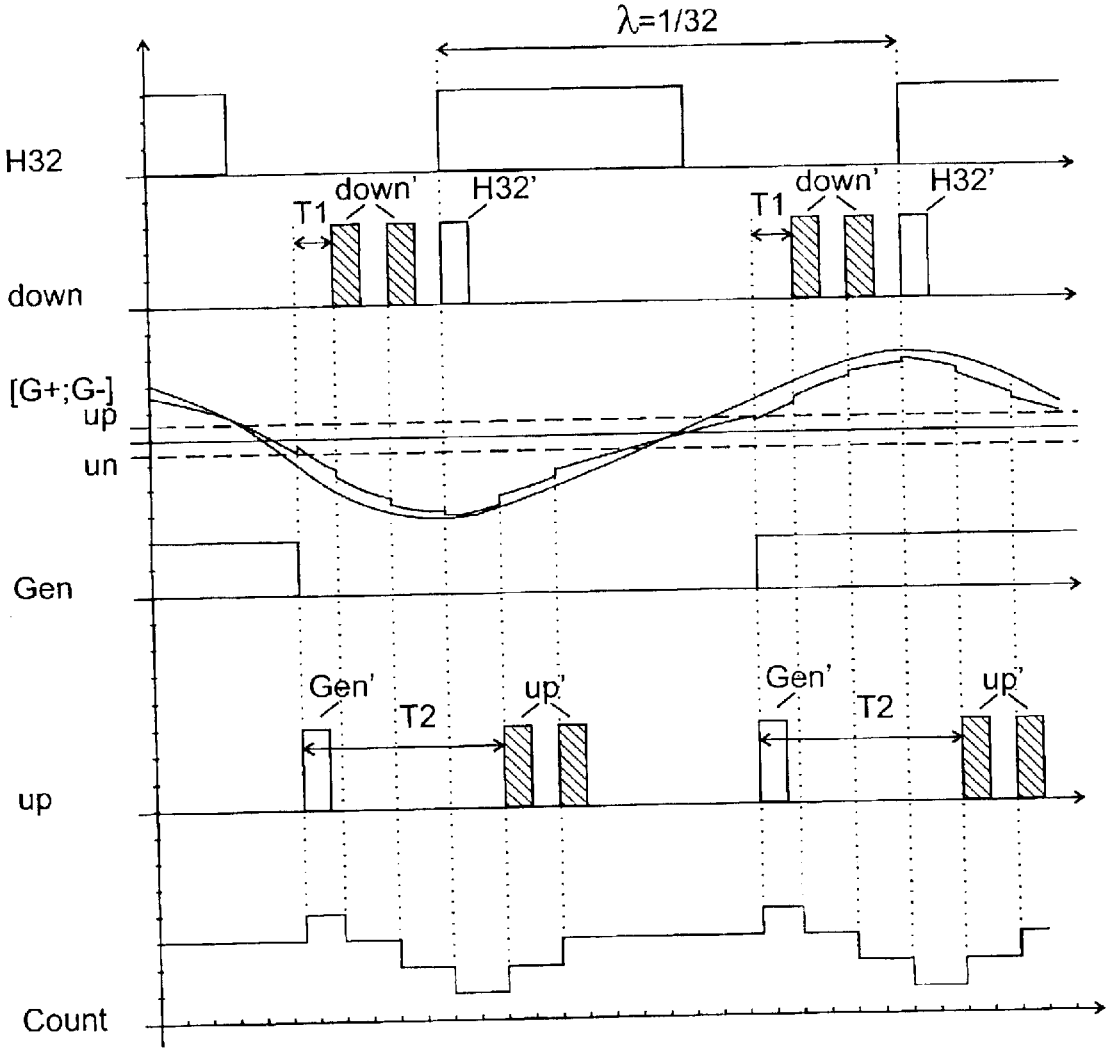
FIG. 4 is a chronogram indicating an example of development of the signals H32 (reference signal of 32 hertz), down, G+; G−, Gen, up, as well as the development of the count value in the counter.

The generator 1 is for example of the asynchronous type and provides an AC voltage between the terminals G+ and G− with a peak-to-peak (extreme-to extreme) voltage of the order of 0.4 volts, for example. A higher voltage is not desirable because it requires employing a generator with larger dimensions. FIG. 4 shows the appearance of the voltage G+, G− at the terminals of the generator. A voltage rectifier and multiplier 2 permits converting this AC voltage to continuous voltage Vdd of about 1 volt, sufficient to supply the circuit 11. The rectifier and multiplier 2 is for example of the type described in the patent EP0 816 955 mentioned above. It preferably uses a circuit permitting switching between the diodes—during startup—and transistors which have a much lower voltage drop, as described in the patent EP0 848 842. The rectifier and multiplier 2 charges a storage capacitor 10 which temporarily stores the electrical energy produced by the generator 1. The rectifier and multiplier 11 moreover uses two capacitors 15 and 16. The capacitors 10, 15, 16 are preferably in the form of separate condensers external to the circuit 11, but could also in a modified embodiment be integrated into this circuit.

The voltage rectifier and multiplier 2 is preferably supplied with current by means of a current source 32 which produce different stabilized currents pp, pn. These currents are also used to supply other components of the circuit 11.

The illustrated circuit 11 comprises a circuit 9 for dissipation of energy connected directly to the outputs G+, G− of the generator 1. The energy dissipation circuit could however also be connected to the output of the rectifier and multiplier 2, for example in parallel with the capacitor 10. As will be seen later, the energy dissipation circuit 9 is constituted in this example by a network of resistances connected in parallel and individually selectable. The braking couple applied to the rotor of the generator is varied by selecting the number of connected resistances. The circuit 9 could however also comprise other types of impedances or even active elements, for example sources of controllable current.

The circuit 11 comprises two pins permitting connecting an external frequency reference, for example a quartz 4, to the input of an oscillator 3. The oscillator 3 supplies the quartz 4 by providing a counter-reaction loop to stabilize the frequency of the quartz. The output of the oscillator is a stable reference signal K32 with a stable frequency of 32 KHz for example. This reference signal attacks a frequency divider 5 which comprises a series of flip-flops so as to provide at its output a rectangular reference signal H32 with a lower frequency, for example 32 Hz, as well as different other sampleup clock signals, sampledown at K1, whose role will be explained later with relation to FIG. 7. The H32 signal is shown in FIG. 4 with its period $\lambda = 1/32$ Hertz. The frequency divider 5 can preferably be calibrated after production and welding of the quartz, so as to compensate imperfections of the quartz and variations between different quartz.

Figure 7:
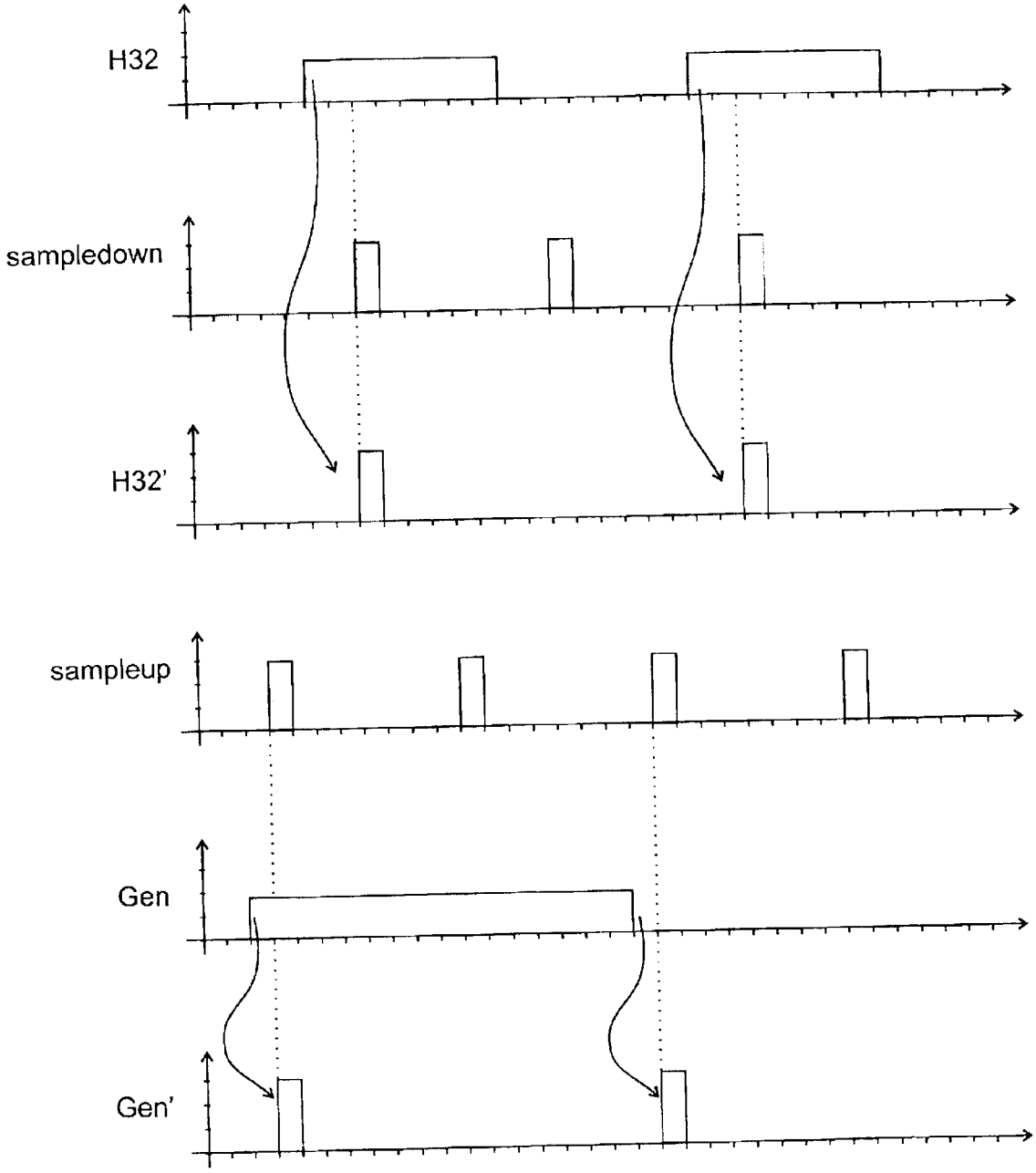
FIG. 7 is a chronogram that explains the operation the anticoincidence circuit.

The circuit 11 moreover comprises a detector 7 of passage through zero, which generates at its output a rectangular signal Gen, shown in FIGS. 4 and 7, whose condition changes with each change of sign of the voltage between the terminals G+; G− at the output of the generator 1. The nominal frequency of the Gen signal is for example 16 Hertz. The detector of passages through zero can be for example a simple comparator which compares the voltage G+ with the voltage G−. There will preferably be used a hysteresis comparator with a positive threshold Up and a negative threshold Un so as to avoid generating parasitic pulses when the output signal of the generator is noisy and passes several times through zero. An analog and/or digital filter can also be used to suppress parasitic pulses arising from a noisy signal. For example, the detector 7 of passages through zero could comprise a digital filter which blocks all the output pulses during a predetermined time, for example a time slightly less than $1/64^{th}$ of a second, after each pulse. In a preferred modification, no filter is used so as to simplify the circuit and reduce its consumption.

The measuring signal Gen at the output of the detector 7 of passage through zero is provided with a reference signal H32 at 32 Hertz at the output of the anticoincidence circuit 8. The circuit 8 permits avoiding the counter 6 described further on from having an indeterminate value when an up pulse and a down pulse are applied simultaneously. FIG. 7 shows, with the help of chronograms, an example of operation of this circuit. It uses two sampleup and sampledown signals generated by the frequency divider 5. The sampleup and sampledown signals are rectangular signals with a frequency of at least 64 Hertz, for example a frequency of 1 Kilohertz, and a very low cycle ratio; the dephasing between sampleup and sampledown is 180°. The anticoincidence circuit 8 generates a pulse H32' generated during the first sampledown pulse after each rising flank of the signal H32 at 32 Hertz. The frequency of pulses H32' is thus equal to 32 Hertz, but the cyclic ratio is lower than that of H32 and the phase is adjacent the sampledown signal.

The anticoincidence circuit generates moreover a pulse Gen' during the first sampleup pulse after each rising or descending flank of the Gen signal. The frequency of the pulse train Gen' is thus twice that of the pulse train Gen. Under nominal conditions, the frequency of the Gen' pulses is 32 Hertz and their phase is adjacent that of the sampleup pulses.

Dephasing between the sampling signals permits ensuring that the H32' and Gen' pulses are not produced simultaneously. The sampling in the anticoincidence circuit can be carried out very simply with the help of flip-flops. Other types of anticoincidence circuits can also be used in the scope of this invention.

The anticoincidence circuit supplies at its output two pulse trains Gen' and H32' whose frequency corresponds respectively to twice that of the measuring signal from the generator 1 and that of the reference signal from the quartz oscillator 3, 4. When the watch operates normally, the pulse trains Gen' and H32' thus have approximately the same frequency and a phase offset.

The two pulse trains are transmitted to a braking modulation circuit 12 which introduces supplemental pulses up' respectively down', synchronized with the help of the K1 signal and whose role will be explained later. The up and down pulse trains as well thus modulated by the circuit 12 are supplied to the up incrementation inputs respectively the decrementation down input of a bi-directional counter 6 with eight bits. The condition of the counter 6 can have any count value between 0 and 255; this value is incremented at each rising flank of the signal on the up input and decremented at each rising flank of the down signal.

The counter 6 is thus incremented at each rising flank or descending flank of the Gen signal from the generator 1 and decremented at each rising flank of the reference signal H32 produced by the quartz. The condition of the counter corresponds to the difference between the number of up pulses and the number of down pulses and hence particularly depends, but not exclusively, on the difference between the advance of the rotor in the generator 1 and the reference given by the quartz. As will be seen later, the condition of the counter is modulated by the circuit 12 and also depends on the instantaneous phase of the measuring signal Gen.

Figure 2:
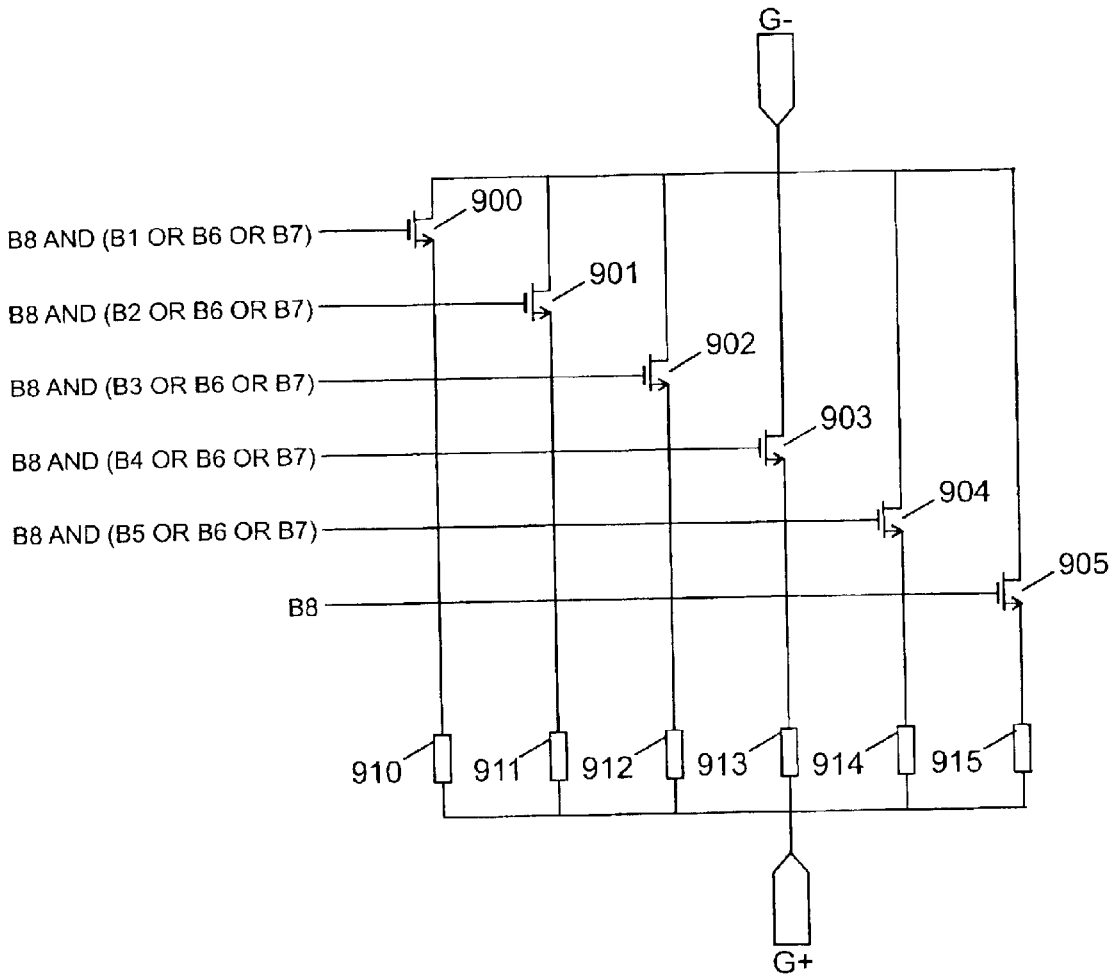
FIG. 2 is an electrical diagram of the system for energy dissipation.

The condition of the counter 6 is shown by 8 output bits B1 to B8 which control the energy dissipation circuit 9, as is seen in particular in FIG. 2. The energy dissipation circuit comprises several resistances 910 to 915 connected in parallel and that can be individually selected by means of control transistors 900 to 905. The values of the different resistances correspond to the weight of the corresponding control bits. Thus the heavy bits at the output of the counter actuate transistors permitting engaging the low value resistances, giving rise to more intense braking of the rotor of the generator.

The output signals of the counter B1 to B8 could control directly the control transistors 900 to 905. However, in the illustrated preferred modification, the number of output bits of the counter 6 is greater than the number of transistors and resistances in the energy dissipation circuit 9. In this example, the 8 output bits B1 to B8 control 6 resistances 910 to 915. The resistance 910 for example has a value of 120 KOhms, whilst the resistances of the greatest weight 911 to 914 have decreasing values, for example a resistance 911 of 60 KOhms, 912 of 30 KOhms, 913 of 15 KOhms and 914 of 6 KOhms. The resistance 915, whose role is explained later, preferably has a very high value, for example 500 KOhms.

A combination logic (not shown) in the circuit 9 permits computing the six control signals of the six transistors 900 to 905 from the eight output signals of the counter 6. In this example, the combination logic permits disconnecting all the resistances 910 to 915 when the bit B8 is inactive, which is to say when the value in the counter 6 is below 128.

The resistances are connected in a selective manner only when B8 is active. In this case, the transistor 900 is passing when the bit B1, controlling the transistor 900 to connect the high value resistance 910, is active. Similarly, the bits of greater weight B2 to B5 cause, via the transistors 901 to 904 respectively, the selection of the resistances 911 to 914. Moreover, when B8 is active at the same time as B6 and/or B7, all the resistances 910 to 915 are connected in parallel so as to reduce to the maximum the impedance applied to the terminals of the generator. The braking is thus at a maximum and is constant when the value in the counter 6 exceeds 160, as is shown in FIG. 3.

The high value resistance 915, for example 500 KOhms, remains permanently connected when the bit 8 is active. In the normal operating regime, a low current thus circulates continuously through this resistance. The resistance 915 thus permits applying a braking couple continuously when the rotor of the generator advances relative to its ideal position, and avoids rapid decelerations if the braking is completely interrupted.

The braking couple applied thus depends exclusively on the count condition of the counter 6. It has been seen that the condition of this counter depends notably on the advance of the rotor of the generator 1 relative to the reference speed indicated by the oscillator 3–4. The braking couple applied thus increases when the rotor advances more rapidly than the reference speed. The use of impedances of high value, greater than 100 KOhms, permits adjusting the braking couple in an extremely fine manner and particularly so as to maintain a braking couple that is reduced but nevertheless continuously applied. It is thus possible to apply variations of the braking couple that are extremely progressive, to the rotor of the generator.

Figure 3:
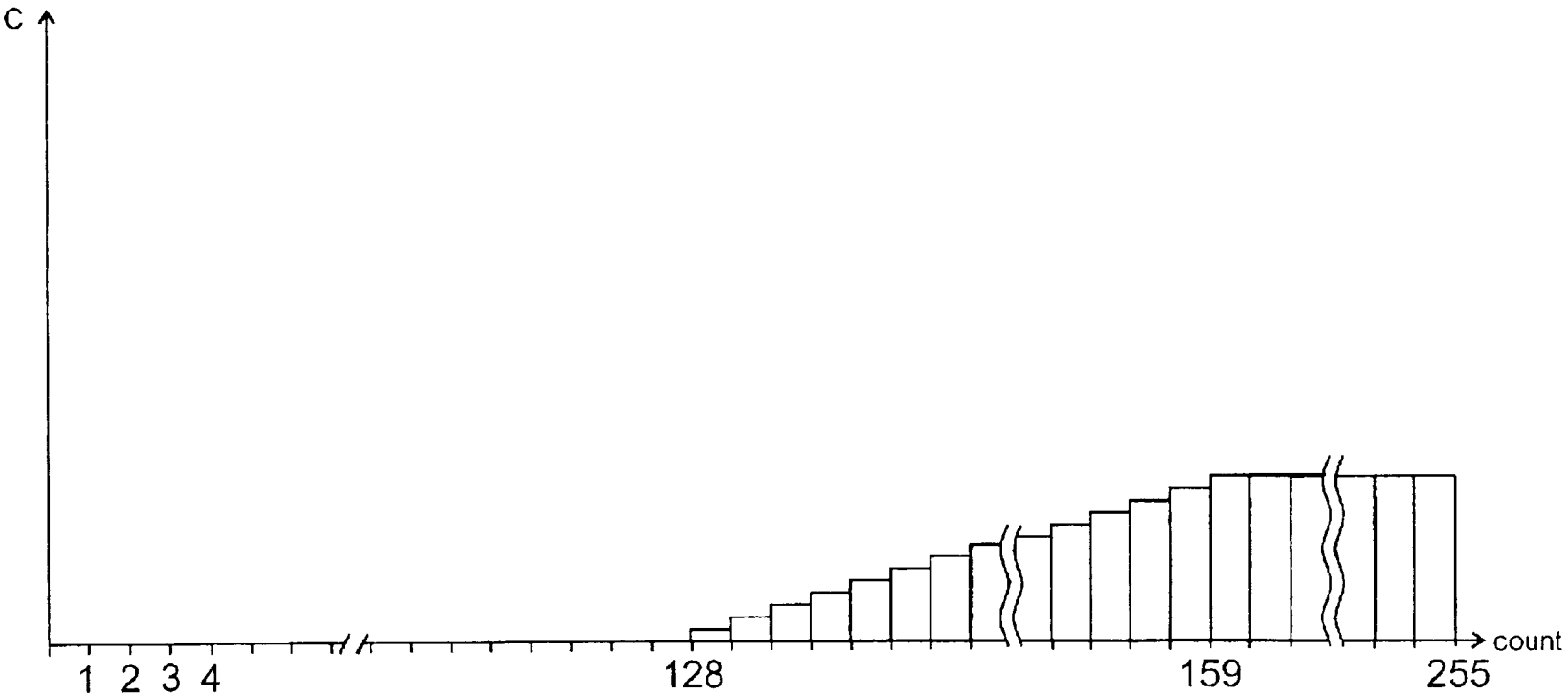
FIG. 3 is a diagram indicating the braking couple as a function of the value of the count in the counter.

FIG. 3 shows the braking couple c applied to the rotor of the generator by the circuit 9 as a function of the count value in the counter 6. In this example, the rotor is not braked when the value in the counter is below 128. There is thereby avoided applying a braking couple, even a low one, at the startup of the system before the rotor has reached and exceeding during a brief instant at its reference speed. The braking couple increases then progressively, so in a substantially linear way, until the counter reaches the value 159. When the watch functions normally, the counter 6 will almost always be in this linear zone between 128 and 159. The braking couple c then becomes saturated at a high value when the counter achieves a value of 160 and beyond. The braking couple applied at these values is sufficient to slow the motor rapidly, even when it is accelerated by a shock, so as to return the system rapidly to the linear zone between 128 and 159.

The use of the 8 bit counter, which counts to 255, permits avoiding the risk that the cyclic counter will not make a complete turn and will not return to zero beyond the maximum value. Those skilled in the art will understand that according to the room available in the integrated circuit 11, it is of course equally possible to use each bit at the output of the counter 6 to control directly a resistance in the energy dissipation system 9.

According to the invention, and returning to FIG. 1, the circuit 11 moreover comprises a braking modulation circuit 12 permitting modifying the condition of the counter 6 as a function of the phase of the measuring signal (G+; G−) at the terminals of the generator 1. The modulation circuit 12 comprises a combination logic, which is not detailed here but which is within the scope of those skilled in the art, permitting adding supplemental down' impulses for decrementation and supplemental up' pulses for incrementation of the counter 6. The supplemental down' pulses are introduced into the pulse train H32' produced by the anticoincidence circuit 8, as will also be seen in FIG. 4. The supplemental up' pulses are as to themselves introduced into the Gen' pulse train produced by the anticoincidence circuit 8. The circuit 12 is arranged so as to add one or several supplemental down' pulses 6 a little before each extreme of the G+/G− signal and an equivalent number of up' incrementation pulses just after each extreme of this signal. As will be appreciated, and as shown in FIG. 4, the extremes of the differential measuring signal occur when the measurement signal reaches its maximum amplitude during a half cycle of that signal, i.e. when the peak-to-peak voltage of the measuring signal reaches its maximum.

The modulation circuit 12 thus permits decrementing momentarily the counter 6, and hence reducing momentarily the braking couple, during voltage extremes (G+; G−) at the terminals of the generator. It is thus possible momentarily to limit the voltage drop at the terminals of the generator, thereby permitting recovering a maximum voltage to recharge the storage capacitors 10, 15, 16 and to guarantee a sufficient supply of the circuit.

The down pulse train produced by the modulation circuit 12 is shown in FIG. 4. As will be seen, this pulse train applied to the decrementation input of the counter 6, comprises on the one hand pulses H32' produced by the anticoincidence circuit 8 from the reference signal H32, and on the other hand supplemental pulses crosshatched down' introduced by the circuit 12 a little before each extreme of the voltage G+; G−. FIG. 4 moreover shows the up pulse train applied to the incrementation input of the counter 6. The up signal comprises the Gen' pulses produced by the anticoincidence circuit 8 from the measuring signal Gen as well as the supplemental crosshatched up' pulses introduced by the circuit 12 a little after each extreme of the voltage G+; G−.

In the illustrated example, the modulation circuit 12 generates two supplemental down' pulses and two supplemental up' pulses before and after respectively each passage through zero of the signal produced by the generator 1. The first down' pulse is generated after an interval of a duration T1, for example 4 milliseconds, after the detection of the passage through zero of the voltage at the terminals of the generator 1 (taking account of hysteresis). The second down' pulse is generated just after the first down' pulse, for example one millisecond later. The first up' pulse is generated after an interval of duration T2, for example 8 milliseconds, after each Gen' pulse. The second up' pulse is generated just after the first up' pulse, for example one millisecond later.

The third line of the chronogram of FIG. 4 shows the development of the voltage between the terminals G+ and G− of the generator 1. The regular curve represents the sinusoidal voltage which will be produced if no braking couple is applied by the circuit 11; the more irregular curve shows how this voltage is reduced when a breaking couple corresponding to successive count values in the counter 6 is applied to the generator. When the rotor of the generator is advanced as in this figure, it will be seen that the voltage G+; G− is continuously reduced: the circuit 11 brakes during all the cycle. The braking couple applied is however momentarily reduced when the amplitude of the signal at the terminals of the generator is a maximum in absolute value. The circuit is thus capable of recharging the storage capacitors 10, 15, 16 with a peak voltage near the theoretical maximum.

The fourth line of the chronogram of FIG. 4 shows the rectangular signal Gen at the output of the detector 7 of passages through zero. In the illustrated example, the detector of passages through zero is constituted by a hysteresis comparator. The Gen signal passes from the logic condition one to the zero logic condition when the voltage between the terminals G+ and G− of the generator 1 falls below the negative value minus one and returns to the logic condition one when the voltage G+; G− rejoins the positive Up threshold. The thresholds Up and Un have been greatly exaggerated in the figure but could, according to the level of noise in the input signal, be closer to each other.

The supplemental down' and up' pulses are generated independently of the relative advance of the measuring signal Gen and of the reference signal H32. The count condition of the counter 6 is thus not only representative of the difference between the number of reference pulses H32' produced by the quartz oscillator 3, 4 and the number of measuring pulses Gen produced by the generator, but also depends on the instantaneous phase of the signal G+, G− between the terminals of the generator 1.

The last line on FIG. 4 does not represent a physical signal, but indicates development of the count value in the bi-directional counter 6. The braking couple applied is, in the linear portion of FIG. 3, substantially proportional to this count value. This value is incremented at each up pulse and decremented at each down pulse. It will be seen that, for each half cycle of the Gen signal, the count value is reduced and then progressively re-established and during a limited time so as to reduce progressively and without abruptness the braking couple applied when the voltage at the terminals of the generator is the maximum. The invention thus permits applying a braking couple continuously to the generator 1, which depends on the advance of the rotor and which is moreover modulated according to the instantaneous phase of the signal G+, G− at the terminals of the generator so as to optimize the charging of the storage capacitors 10, 15, 16 and without abrupt variations of the braking couple applied.

If the generator turns at a frequency greatly superior to the reference speed, for example following a shock, a passage through zero of the signal G; G− can take place before the last supplemental up' pulse triggered by the preceding passage through zero. This new passage through zero triggers a new series of supplemental down' and up' pulses, which overlap with the preceding supplemental series of pulses. The counter can thus under certain circumstances momentarily have unintended values which do not correspond to the braking couple that it is desired to apply. So as to avoid these transitory disturbances, in a preferred modification of the invention, an up pulse does not trigger supplemental up' and down' pulses unless the interval of reduction of braking caused by the preceding passage through zero is completely over. In another modification, the duration of the intervals T1 and T2 is made independent of the signal frequency G+; G−.

Figure 5:
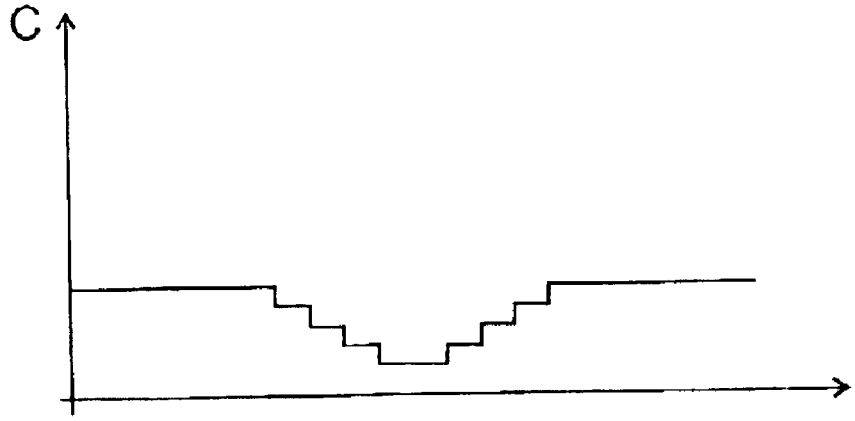
FIG. 5 is a diagram showing an example of development of the braking couple in another modification of the invention.

In the example of FIG. 4, two supplemental down' decrementation impulses and two supplemental up' incrementation pulses are used. The number of supplemental pulses used can however be greater so as to give rise to a greater or more progressive reduction of the braking couple. FIG. 5 shows an example of the development of the braking couple in which four supplemental down' and up' pulses are used.

Figure 6:
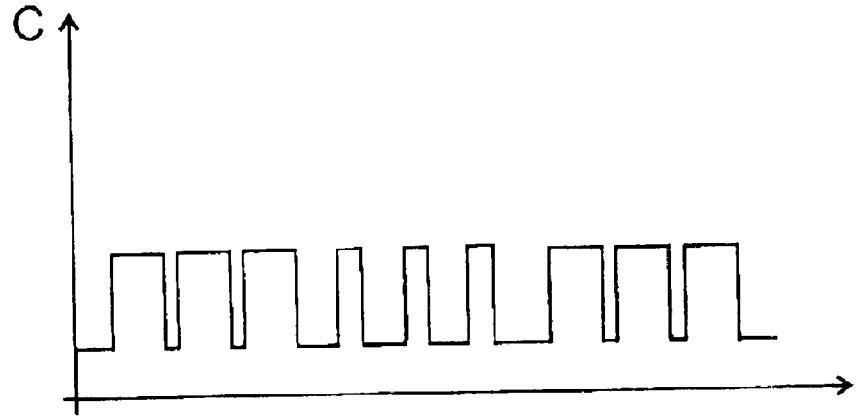
FIG. 6 is a diagram showing an example of the development of the braking couple in another modification of the invention.

FIG. 6 shows a modification of the invention in which the braking couple applied continuously to the generator is pulsed. The amplitude of the pulses, and/or the amplitude of a continuous component added to the pulses, and/or in the illustrated example the cycle ratio of the pulses, depends on the value in counter 6. As in the preceding examples, this value is modulated so as to reduce the braking, without completely interrupting it, when the amplitude of the voltage at the terminals of the generator passes through an extreme. According to the invention, the braking couple C does not fall back to zero, even between different peaks of the pulse braking.

Those skilled in the art will easily conceive other means to reduce, for a limited time, without abrupt variation, the braking couple applied to the rotor. The braking couple can also vary continuously, particularly when the energy dissipation circuit is constituted by a controllable current source, or by using impedances whose value can be continuously varied.

In the examples discussed above, the braking couple is temporarily and progressively reduced by adding supplemental down' and up' pulses at the input of the bi-directional counter 6. It would also be possible, within the scope of modifications within the reach of those skilled in the art, to act on the output of the counter 6 with a subtractor arranged to subtract, for a limited time, a fixed or variable value. Similarly, it would also be possible to act directly on the energy dissipation circuit 9 and to use for example an impedance or a network of impedances of controllable resultant value in parallel or in series with the other impedances. The value of this impedance could thus be controlled such that it depends on the instantaneous phase of the voltage at the output of the generator, so as progressively to increase the resulting impedance when the voltage at the terminals of the generator passes through an extreme.

The operation of the regulation module described above is of the integral type; the counter-reaction applied in the form of a braking couple to the generator 1 depends particularly, but not exclusively, on the difference accumulated in the counter 6, between the number of up pulses from the generator and the number of down pulses from the quartz oscillator. When a more rapid correction is desirable, for example if it is important that the watch correct the operational errors very rapidly so as to display at each instance a precise time, it is also possible within the scope of this invention to apply a proportional regulation to the momentary speed of the rotor, even proportional to the derivative of this momentary speed, or even a combination of these different possibilities for adjustment, for example a PDI (proportional-integral-differential) adjustment.

What is claimed is:

1. Electronic regulation module for a watch movement with mechanical winding, comprising:

a generator permitting converting the mechanical energy supplied by said watch movement into a measuring signal, an electronic circuit supplied by said generator, said electronic circuit comprising an energy dissipating circuit permitting applying at least two separate non-zero braking couples to said generator, said electronic circuit moreover comprising a control circuit of the braking circuit, so as to control the speed of rotation of said generator, the braking couple selected by said control circuit depending particularly on the advance of said generator, characterized in that said control circuit for the braking circuit is arranged so as to reduce the braking couple when said measuring signal passes through an extreme.

2. Electronic module according to claim 1, in which said braking couple is reduced without being completely suppressed when said measuring signal passes through an extreme, so as to apply a braking couple continuously when said generator is advanced relative to its ideal position.

3. Electronic module according to claim 2, in which said braking couple is reduced during a fixed interval of time when said measuring signal passes through an extreme.

4. Electronic module according to claim 1, in which said control circuit is so arranged as to apply a braking couple continuously when said generator is in advance, except during a limited interval of time when said measuring signal passes through an extreme.

5. Electronic module according to claim 3, in which said braking couple is progressively reduced before said measuring signal passes through an extreme, then progressively reestablished after said measuring signal has passed through said extreme.

6. Electronic module according to claim 1, in which said braking circuit comprises a plurality of impedances of different values which can be independently selected by said control circuit so as to vary the couple applied to said generator, the greatest value of the impedance (915) being greater than or equal to 100 KOhms.

7. Electronic module according to claim 1, in which said control circuit of the braking circuit comprises a bi-directional counter which is incremented at each half cycle of said measuring signal and decremented at each half cycle of a reference signal, said counter being moreover decremented before said measuring signal passes through an extreme, then incremented after said measuring signal has passed through said extreme, the braking couple applied being determined by the content of the counter.

8. Electronic regulation module for a watch movement with mechanical winding, comprising:

a generator permitting converting the mechanical energy supplied by said watch movement into a measuring signal, an electronic circuit supplied by said generator, said electronic circuit comprising an energy dissipation circuit comprising a plurality of impedances of different values that can be independently selected so as to permit the application of at least two separate braking couples more than zero, to said generator, said electronic circuit moreover comprising a control circuit for the energy dissipation circuit permitting controlling the speed of rotation of said generator by selecting different impedances in said energy dissipation circuit as a function of the advance of said generator, characterized in that the resulting impedance of the energy dissipation circuit when the generator is advanced and said measuring signal passes through an extreme, has a finite value greater than or equal to 100 KOhms.

9. Process for regulating the speed of a watch movement with mechanical winding with the help of a generator and an electronic control circuit for said generator, the speed of said watch movement being adjusted by controlling by means of the electronic control circuit braking couple applied to said generator, at least two separate braking couples greater than zero being adapted to be applied, characterized in that the momentary braking couple is reduced when a measuring signal at the output of said generator passes through an extreme.

10. Process according to claim 9, in which the momentary braking couple depends moreover on the advance of said generator.

11. Process according to claim 9, in which a braking couple is applied continuously when said generator is advanced, said braking couple being reduced or interrupted during an interval of a limited duration when said measuring signal passes through an extreme.

12. Process according to claim 10, in which said braking couple is progressively reduced before said measuring signal passes through an extreme, then progressively reestablished after said measuring signal passes through said extreme.

13. Process according to claim 9, in which said electronic module can impose at least 128 different braking signals on said generator.

14. An electronic regulation module for a watch movement with a mechanical winding, comprising:

a generator for converting a mechanical energy supplied by a watch movement with a mechanical winding into a measuring signal, the generator having a controllable speed of rotation;

an electronic circuit supplied by said generator; and an energy dissipating circuit connected to control the speed of rotation of the generator, the energy dissipating circuit permitting application of at least two separate non-zero braking couples to said generator, the electronic circuit comprising i) a braking control circuit for controlling the energy dissipating circuit, and thereby controlling the speed of rotation of said generator, in response to an advance of said generator, and ii) a braking modulation circuit for modulating a control provided by said braking control circuit in response to a phase of the measuring signal and independently from the advance of said generator.

15. The electronic regulation module of claim 14, wherein, the braking control circuit controls the energy dissipating circuit by varying an impedance of the energy dissipating circuit through plural impedance values to vary the braking couple through plural non-zero values, the measuring signal provided the generator is an AC voltage signal with peak-to-peak voltages, and the braking control circuit, via the energy dissipating circuit, reducing the braking couple, to a non-zero value, when the AC voltage signal during the peak-to-peak voltages.

16. The electronic regulation module of claim 15, wherein, the braking modulation circuit, during the peak-to-peak voltages, reduces the braking couple applied to the generator, the action of the braking control circuit and the braking modulation circuit being independent.

17. The electronic regulation module of claim 15, wherein, the braking control circuit regulates the braking couple without completely suppressing the braking couple when said measuring signal passes through a peak-to-peak voltage, so as to apply a braking couple continuously when said generator is advanced relative to a ideal position.

18. The electronic regulation module of claim 17, wherein, the braking control circuit reduces the braking couple during a fixed interval of time when said measuring signal passes through a peak-to-peak voltage.

19. The electronic regulation module of claim 15, wherein, energy dissipating circuit comprises a plurality of impedances of different values independently selectable by said braking control circuit so as to vary the couple applied to said generator, the greatest value of the impedance being at least 100 KOhms.

20. A method of controlling braking of a generator for converting a mechanical energy supplied by a watch movement with a mechanical winding, comprising the steps of:

connecting a generator, for converting a mechanical energy supplied by a watch movement with a mechanical winding into a measuring signal, to supply an electronic circuit having a braking control circuit and a braking modulation circuit;

with the braking control circuit, controlling an energy dissipating circuit to control a speed of rotation of said generator in response to an advance of said generator, wherein the energy dissipating circuit permits application of at least two separate non-zero braking couples to said generator; and with the braking modulation circuit, modulating a control provided by said braking control circuit in response to a phase of the measuring signal, the modulating being independent from the advance of said generator.

* * * * *